US006056630A

United States Patent [19]

Nanda et al.

[11] Patent Number: 6,056,630

[45] Date of Patent: May 2, 2000

[54] POLISHING APPARATUS WITH CARRIER HEAD PIVOTING DEVICE

[75] Inventors: Arun K. Nanda, Orlando; Laurence D. Schultz, Kissimmee, both of Fla.

[73] Assignee: Lucent Technologies Inc., Murray Hill, N.J.

[21] Appl. No.: 09/081,406

[22] Filed: May 19, 1998

[51] Int. Cl.[7] ..... B24B 7/22

[52] U.S. Cl. ..... 451/287; 451/41

[58] Field of Search ..... 451/28, 41, 287, 451/288, 397, 398

[56] References Cited

U.S. PATENT DOCUMENTS

| | | | |
|---|---|---|---|
| 4,271,635 | 6/1981 | Szalay | 51/5 D |
| 5,016,399 | 5/1991 | Vinson | 51/118 |
| 5,121,572 | 6/1992 | Hilscher | 51/111 |
| 5,365,700 | 11/1994 | Sawada et al. | 451/28 |
| 5,645,473 | 7/1997 | Togawa et al. | 451/287 |
| 5,653,624 | 8/1997 | Ishikawa et al. | 451/287 |
| 5,655,954 | 8/1997 | Oishi et al. | 451/67 |
| 5,676,590 | 10/1997 | Hiraoka | 451/287 |
| 5,679,055 | 10/1997 | Greene et al. | 451/10 |

*Primary Examiner*—Joseph J. Hail, III
*Assistant Examiner*—Dermott J. Cooke

[57] ABSTRACT

The present invention provides a unique polishing apparatus, such as a chemical/mechanical polishing apparatus, that includes a pivoting apparatus having a first end coupled to a carrier head and a second end coupled to a rotatable shaft wherein the pivoting apparatus is configured to exert a pivoting force with respect to the carrier head to pivot the carrier head with respect to the rotatable shaft to more easily break the surface tension formed by the slurry during the polishing process. This system provides a polishing apparatus that can reduce the amount of semiconductor wafer breakage associated with present processes and apparatus.

28 Claims, 5 Drawing Sheets

POLISHING APPARATUS WITH CARRIER HEAD PIVOTING DEVICE

TECHNICAL FIELD OF THE INVENTION

The present invention is directed, in general, to a polishing apparatus and, more specifically, to a polishing apparatus having a polishing head tilting device associated therewith.

BACKGROUND OF THE INVENTION

In the fabrication of semiconductor components, the various devices are formed in layers upon an underlying substrate that is typically composed of silicon, germanium, or gallium arsenide. The various discrete devices are interconnected by metal conductor lines to form the desired integrated circuits. The metal conductor lines are further insulated from the next interconnection level by thin films of insulating material deposited by, for example, CVD (Chemical Vapor Deposition) of oxide or application of SOG (Spin On Glass) layers followed by fellow processes. Holes, or vias, formed through the insulating layers provide electrical connectivity between successive conductive interconnection layers. In such microcircuit wiring processes, it is desirable that the insulating layers have a smooth surface topography, since it is difficult to lithographically image and pattern layers applied to rough surfaces.

Conventional chemical/mechanical polishing (CMP) has been developed for providing smooth semiconductor topographies. Chemical/mechanical polishing (CMP) can be used for planarizing: (a) insulator surfaces, such as silicon oxide or silicon nitride, deposited by chemical vapor deposition; (b) insulating layers, such as glasses deposited by spin-on and reflow deposition means, over semiconductor devices; or (c) metallic conductor interconnection wiring layers. Semiconductor wafers may also be planarized to: control layer thickness, sharpen the edge of via "plugs", remove a hardmask, remove other material layers, etc. Significantly, a given semiconductor wafer may be planarized several times, such as upon completion of each metal layer. For example, following via formation in a dielectric material layer, a metallization layer is blanket deposited and then CMP is used to produce planar metal studs.

Briefly, the CMP process involves holding and rotating a thin, reasonably flat, semiconductor wafer against a rotating polishing surface. The polishing surface is wetted by a chemical slurry, under controlled chemical, pressure, and temperature conditions. The chemical slurry contains a polishing agent, such as alumina or silica, which is used as the abrasive material. Additionally, the slurry contains selected chemicals which etch or oxidize selected surfaces of the wafer during processing. The combination of mechanical and chemical removal of material during polishing results in superior planarization of the polished surface. In this process it is important to remove a sufficient amount of material to provide a smooth surface, without removing an excessive amount of underlying materials. Accurate material removal is particularly important in today's submicron technologies where the layers between device and metal levels are constantly getting thinner.

One problem area associated with chemical/mechanical polishing is in the step of removing the planarized wafer from the polishing surface without damaging the wafer. In addition to its function as a chemical and mechanical abrasive, the chemical slurry acts as a lubricant similar to oil. As the process proceeds, all gases, e.g., air, are expelled from between the wafer and the polishing pad. The resultant effect is the formation by adsorption of a thin film between the surface of the polishing pad and the surface of the wafer. The film of slurry adheres to the surfaces of both the semiconductor wafer and the polishing pad. Thus, when the CMP process is complete and the wafer is to be removed for the next processing step, the semiconductor wafer clings to the polishing pad. It is necessary to break the seal between the wafer and the polishing pad without damaging the wafer and to transport the wafer to the cleaning station. One method that has been used to accomplish this task is to lift the wafer in the carrier head vertically from the polishing pad. However, the force that adheres the wafer to the polishing pad can be sufficient to pull the wafer from the carrier head, thus complicating retrieval of the wafer or damaging the wafer. An alternative method employed is that of sliding the wafer off the edge of the polishing pad, thereby breaking the seal. However, this often results in the wafer falling off the edge of the polishing pad and being damaged as it strikes some part of the processing chamber.

Additionally, the endpoint of the CMP process may have to be determined experimentally, i.e., the wafer lifted from the polishing surface and visually or optically inspected after a specific processing time. This introduces a significant opportunity for wafer damage, as the inspection may have to be performed several times until the desired finish or surface removal has been accomplished.

Accordingly, what is needed in the art is a polishing apparatus and method for its use that will efficiently break the seal between a semiconductor wafer and a CMP polishing pad without damage to the semiconductor wafer.

SUMMARY OF THE INVENTION

To address the above-discussed deficiencies of the prior art, the present invention provides a unique polishing apparatus that avoids the problems associated with prior art polishing devices. In one advantageous embodiment, the polishing apparatus comprises a polishing surface against which an object is to be polished. The polishing surface typically may be a rotatable polishing pad or polishing table that is turned by a motor. This embodiment further includes a rotatable shaft having an axis substantially normal to the polishing surface. The rotatable shaft is also coupled to a motor that turns the shaft in the same direction as the polishing surface. The rotatable shaft may be of conventional design that has a hollow portion therethrough for applying a vacuum against the object to hold it during the pick-up step.

This particular advantageous embodiment further includes a carrier head pivotably coupled to and rotatable with the rotatable shaft. The carrier head also may be of conventional design wherein it is configured to retain the object during the step of picking up the object and during the step of polishing the object. One example in which it may do this is by a carrier ring, which preferably includes a carrier ring that is configured to retain the object to be polished therein or by vacuum. The carrier head is engageable against the polishing surface by way of the rotatable shaft and has an operating angle substantially normal to the rotatable shaft.

Additionally, this embodiment includes a unique pivoting apparatus that has a first end coupled to the carrier head and a second end coupled to the rotatable shaft. In a general embodiment, the pivoting apparatus is configured to exert a pivoting force with respect to the carrier head to pivot the carrier head with respect to the rotatable shaft.

In another embodiment, the pivoting apparatus includes first and second pivoting devices coupled on opposing sides of the carrier head. The first and second pivoting devices each have first ends coupled to the carrier head and second ends coupled to the rotatable shaft. This unique configuration provides a system whereby the carrier head can be titled or pivoted to break the fluid surface tension that typically forms between the polishing surface and the object during the polishing process. In certain embodiments, the pivoting apparatus is configured to pivot the carrier head to an angle relative to the rotatable shaft sufficient to break a slurry surface tension created during polishing of the object. In such embodiments, the angle may range from less than about 90 degrees to about 60 degrees with respect to the rotatable shaft.

In another embodiment, the pivoting apparatus may be fluid actuated and configured to exert a pivoting force with respect to the carrier head in response to a change of fluid pressure within the pivoting apparatus. In an alternative embodiment, the pivoting apparatus may be a pneumatic actuated cylinder in fluid connection with a gas reservoir by a conduit. In yet another alternative embodiment, the pivoting apparatus may be a hydraulic actuated cylinder in fluid connection with a hydraulic fluid reservoir by a conduit.

In yet another embodiment the pivoting apparatus may be a mechanical driver system operably coupled to a motor and the carrier head is pivoted by the mechanical driver system.

Another aspect of the present invention provides a polishing apparatus that also includes an embodiment where the rotatable shaft is coupled to a swing arm rotatable about a vertical axis of the polishing apparatus, which allows the carrier head to be rotated between the polishing surface and a supply of objects that are to be polished.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

To address the deficiencies of the prior art, the present invention provides a unique chemical/mechanical polishing (CMP) apparatus that can reduce the amount of breakage associated with the removal of the semiconductor wafer following CMP with conventional devices. The general method of planarizing the surface of a semiconductor wafer, using CMP polishing, and the new and improved method of wafer release will now be described in detail. The method may be applied when planarizing: (a) insulator surfaces, such as silicon oxide or silicon nitride, deposited by chemical vapor deposition; (b) insulating layers, such as glasses deposited by spin-on and reflow deposition means, over semiconductor devices; or (c) metallic conductor interconnection wiring layers.

Figure 1A:
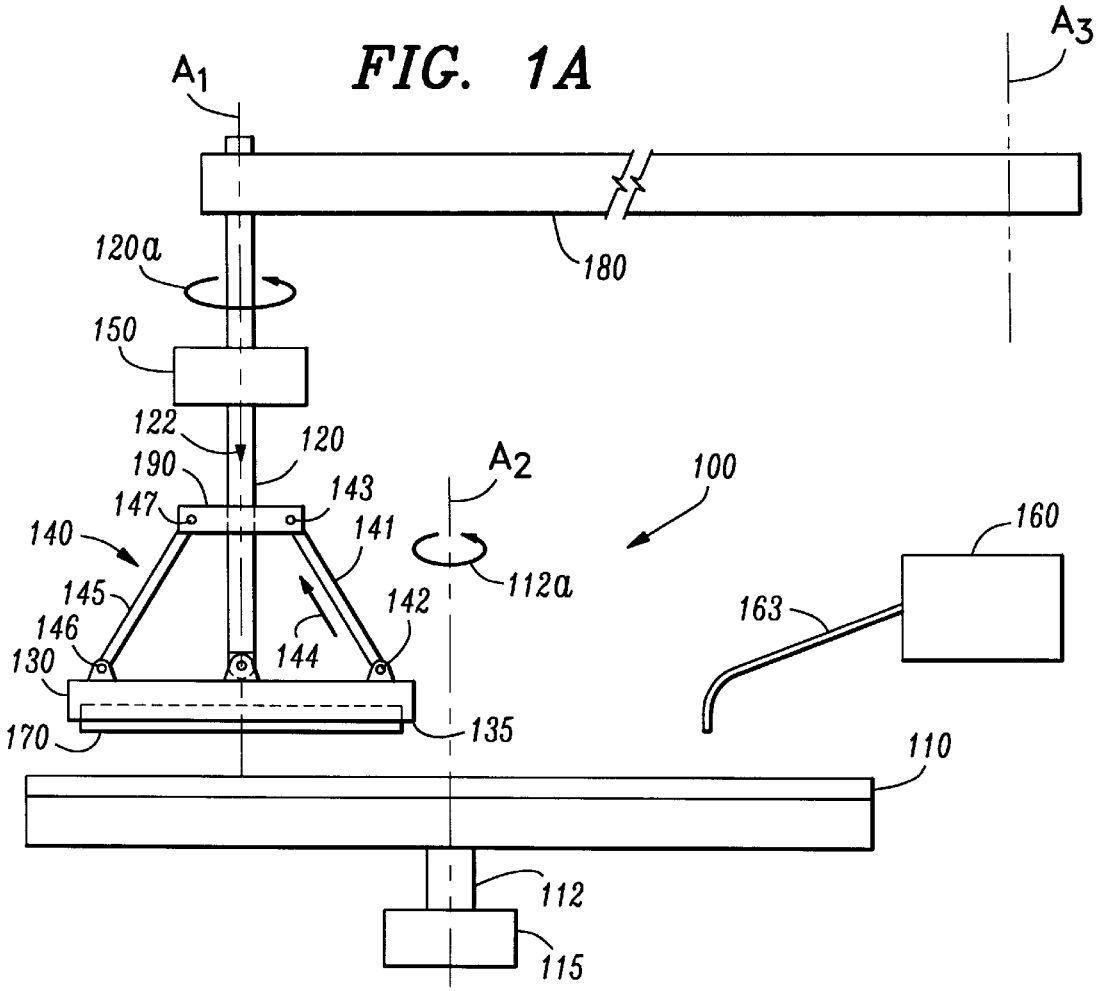
FIG. 1A illustrates a schematic elevational view of an exemplary embodiment of a chemical/mechanical planarization (CMP) apparatus constructed according to the principles of the present invention.

Referring initially to FIG. 1A, illustrated is a schematic elevational view of an exemplary embodiment of a CMP apparatus constructed according to the principles of the present invention. The CMP apparatus, generally designated 100, comprises a polishing surface or polishing pad 110, a rotatable shaft 120, a carrier head 130, a pivoting apparatus 140, a first drive motor 150, and a temperature controlled reservoir 160 for slurry delivery. The polishing surface 110 is substantially horizontal and acts as a platen against which an object 170 may be planarized. In an advantageous embodiment, the object 170 is a semiconductor wafer. Thus, this particular embodiment is quite useful in the fabrication of integrated circuits formed on semiconductor wafers. The rotatable shaft 120 is pivotably coupled to the carrier head 130 and has an axis $A_1$ that is substantially normal to the polishing surface 110. The carrier head 130 is rotatable by the rotatable shaft 120 about the axis $A_1$ and is configured to retain the semiconductor wafer 170. The rotatable shaft 120 and carrier head 130 are mounted to the first drive motor 150 for continuous rotation about axis $A_1$ in a direction indicated by arrow 120*a*. The carrier head 130 is further adapted so that a force indicated by arrow 122 is exerted on the semiconductor wafer 170. The semiconductor wafer 170, by way of the carrier head 130 and the rotatable shaft 120, is engageable against the polishing surface 110. In an advantageous embodiment, the carrier head 130 comprises a retaining ring 135 that prevents the semiconductor wafer 170 from fleeing the carrier head 130 under the forces of rotation.

When in the polishing position, the face of the carrier head 130 has an operating angle substantially normal to the rotatable shaft 120; that is the operating angle is between about 85° and 90° as measured from the rotatable shaft 120. In an alternative embodiment, the polishing surface 110 is coupled to and rotated by a second rotatable shaft 112 driven by a second motor 115. The polishing surface 110 and second rotatable shaft 112 are rotated about an axis $A_2$ that is substantially parallel to the axis $A_1$. In a particular aspect of this embodiment, the first rotatable shaft 120 and the second rotatable shaft 112 rotate in the same direction indicated by arrows 120*a*, 112*a*, respectively. In another alternative embodiment, the CMP apparatus 100 further comprises a swing arm 180 rotatable about an axis $A_3$ of the polishing apparatus 100. In this embodiment, the axis $A_3$ is substantially parallel to axes $A_1$ and $A_2$.

In the illustrated embodiment, the pivoting apparatus 140 comprises first and second pivoting devices 141, 145 that are movably coupled to the carrier head 130 at their respective first ends 142, 146. The first and second pivoting devices 141, 145 are likewise movably coupled to the rotatable shaft 120 at their respective second ends 143, 147 through an attachment collar 190. The pivoting apparatus 140 is configured to exert a pivoting force 144 with respect to the carrier head 130 to pivot the carrier head 130 with respect to the rotatable shaft 120. Although the illustrated embodiment details first and second pivoting devices 141, 145, one skilled in the art will recognize that single or multiple, e.g., 3, 4, etc., pivoting devices could likewise be employed for the purposes of the present invention. A polishing slurry containing an abrasive fluid, such as silica or alumina abrasive particles suspended in either a basic or an acidic solution, is dispensed onto the polishing surface 110 through a conduit 163 from the temperature controlled reservoir 160.

Figure 1B:
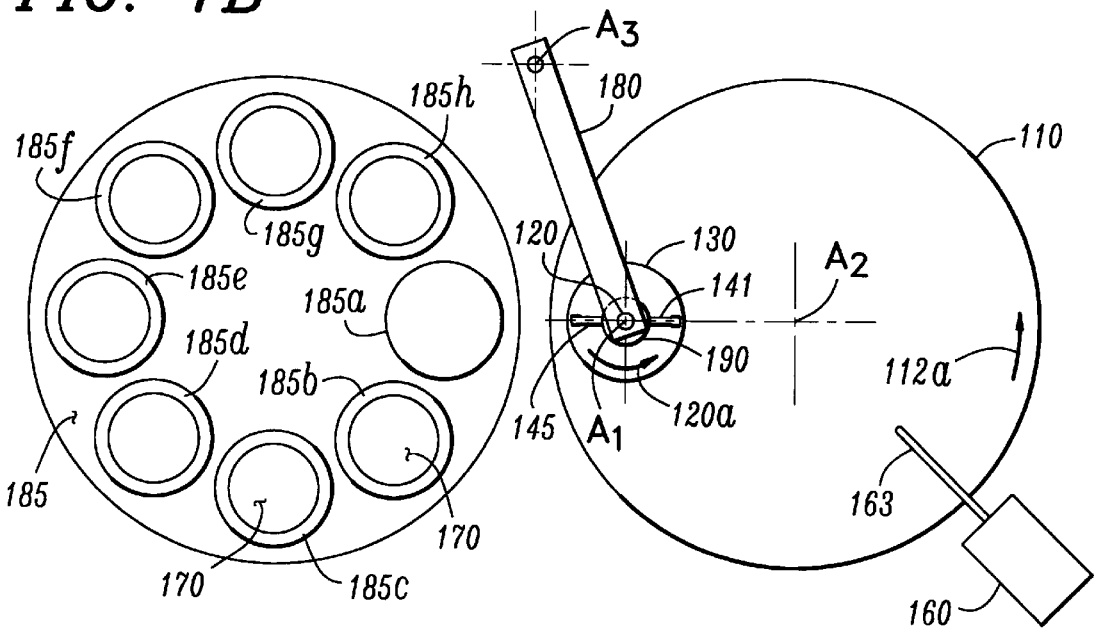
FIG. 1B illustrates a schematic plan view of the CMP apparatus of FIG. 1A with the key elements shown.

Referring now to FIG. 1B with continuing reference to FIG. 1A, illustrated is a schematic plan view of the CMP apparatus of FIG. 1A with the key elements shown. The carrier head 130 and rotatable shaft 120 are shown to rotate in a direction indicated by arrow 120*a* about the axis $A_1$. The polishing surface 110 is shown to rotate in a direction indicated by arrow 112*a* about the axis $A_2$. The first and second pivoting devices 141, 145 are movably coupled to the carrier head 130 and to the attachment collar 190. Polishing slurry is dispensed onto the polishing surface 110 through the conduit 163 from the temperature controlled reservoir 160. In an alternative embodiment, the CMP apparatus may further comprise a loading/unloading station 185 with locations 185*a*–185*h* that store the semiconductor wafers 170 before and after CMP processing. The semiconductor wafers 170 are transported between the supply station 185 and the polishing surface 110 by rotating the carrier head 130 with the swing arm 180.

Figure 2:
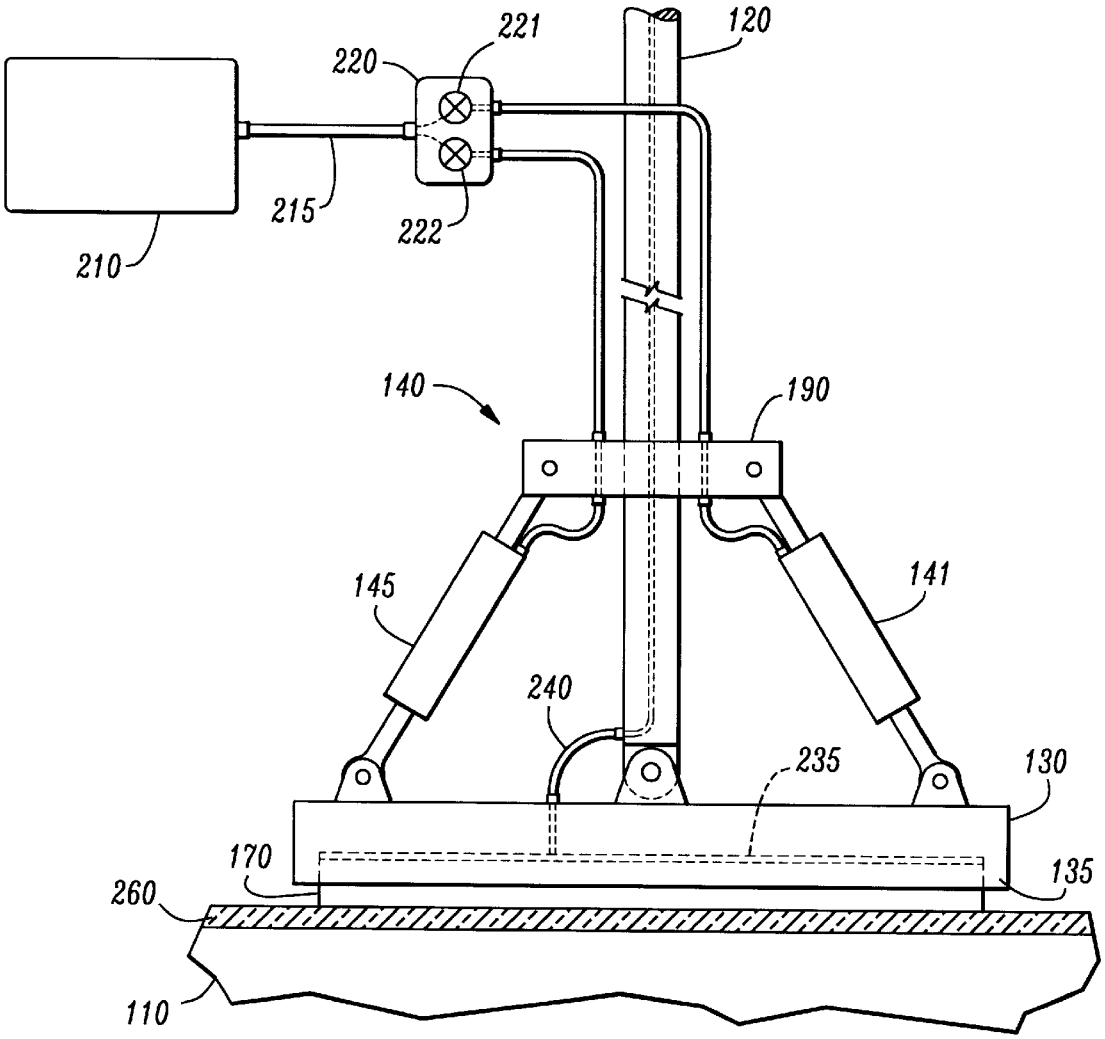
FIG. 2 illustrates a profile view of one embodiment of the pivoting apparatus of FIGS. 1A and 1B.

Referring now to FIG. 2 with continuing reference to FIG. 1B, illustrated is a profile view of one embodiment of the pivoting apparatus of FIGS. 1A and 1B. CMP has been completed; and all rotation of the carrier head 130 and polishing surface 110 has ceased. The semiconductor wafer 170 must now be removed from the polishing surface 110. During transport to and from the supply station 185, the semiconductor wafer 170 is held within a recess 235 in the carrier head 130 by a vacuum applied through a vacuum line 240. The semiconductor wafer 170 is separated from the polishing surface 110 by a slurry film 260. In the illustrated embodiment, the pivoting apparatus 140 comprises fluid-actuated first and second pivoting devices 141, 145 coupled on opposing sides of the carrier head 130. Likewise, the first and second pivoting devices 141, 145 are coupled on opposing sides of the rotatable shaft 120 through the attachment collar 190. In one embodiment of the pivoting apparatus, the first and second pivoting devices 141, 145 may be conventionally designed pneumatic actuated cylinders in fluid connection with a gas reservoir 210 by a conduit 215. The control of pneumatic pressure to the first and second pivoting devices 141, 145 may be achieved through a manifold 220 with valves 221 and 222. In an alternative embodiment, the first and second pivoting devices 141, 145 may be conventionally designed vacuum actuated cylinders in fluid connection with a vacuum source 210 by a conduit 215. Likewise, the control of vacuum to the first and second pivoting devices 141, 145 may be achieved through manifold 220 with valves 221 and 222. In yet another alternative embodiment, the first and second pivoting devices 141, 145 may be conventionally designed hydraulic actuated cylinders in fluid connection with a hydraulic fluid reservoir 210 by a conduit 215. In this embodiment, the control of hydraulic pressure to the first and second pivoting devices 141, 145 may be achieved through manifold 220 with valves 221 and 222. One who is skilled in the art is familiar with the design and implementation of vacuum, hydraulic and pneumatic actuating cylinders. In yet another alternative embodiment, the first and second pivoting devices 141, 145 may be a mechanical driver system operably coupled to a motor that pivots the carrier head 130 in a manner similar to the vacuum, pneumatic, or hydraulic devices previously described. One who is skilled in the art is familiar with such mechanical driver systems. In yet another alternative embodiment, the types of pivoting devices, i.e., pneumatic, vacuum, mechanical, or hydraulic, may be mixed in a single pivoting apparatus 140, e.g., one vacuum device and one hydraulic device.

Figure 3:
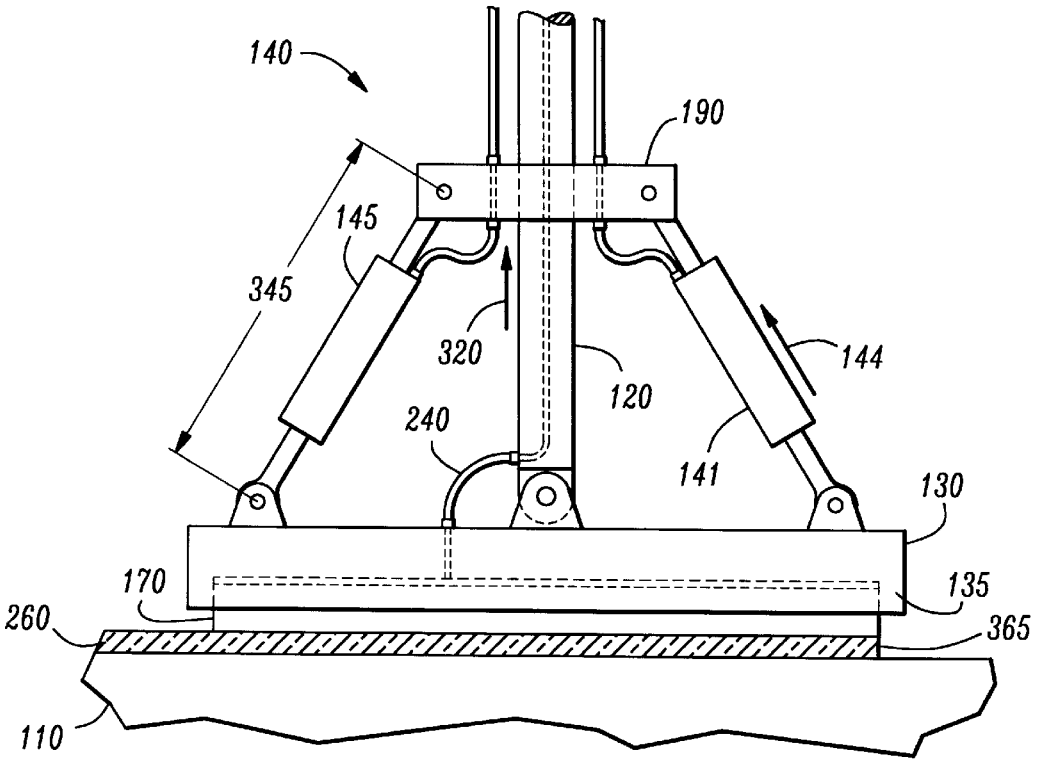
FIG. 3 illustrates a profile view of the pivoting apparatus of FIG. 2 as the pivoting apparatus is actuated.

Referring now to FIG. 3, illustrated is a profile view of the pivoting apparatus of FIG. 2 as the pivoting apparatus is actuated. The semiconductor wafer 170 is held in contact with the polishing surface 110 by the adhesion of the slurry film 260. With the rotatable shaft 120 free to move in a vertical direction, one of the first or second pivoting devices 141, 145 is actuated. In the illustrated embodiment, vacuum has been selectively applied to the first pivoting device 141 while the second pivoting device 145 holds to a fixed length 345. The pivoting force 144 is generated in the first pivoting device 141 causing it to contract in length. As the first pivoting device 141 shortens in length, the first rotating shaft 120 slides vertically 320 through the attachment collar 190 that is restrained by the second pivoting device 145. A meniscus 365 is formed in the polishing slurry 260 between the polishing surface 110 and the semiconductor wafer 170.

Figure 4:
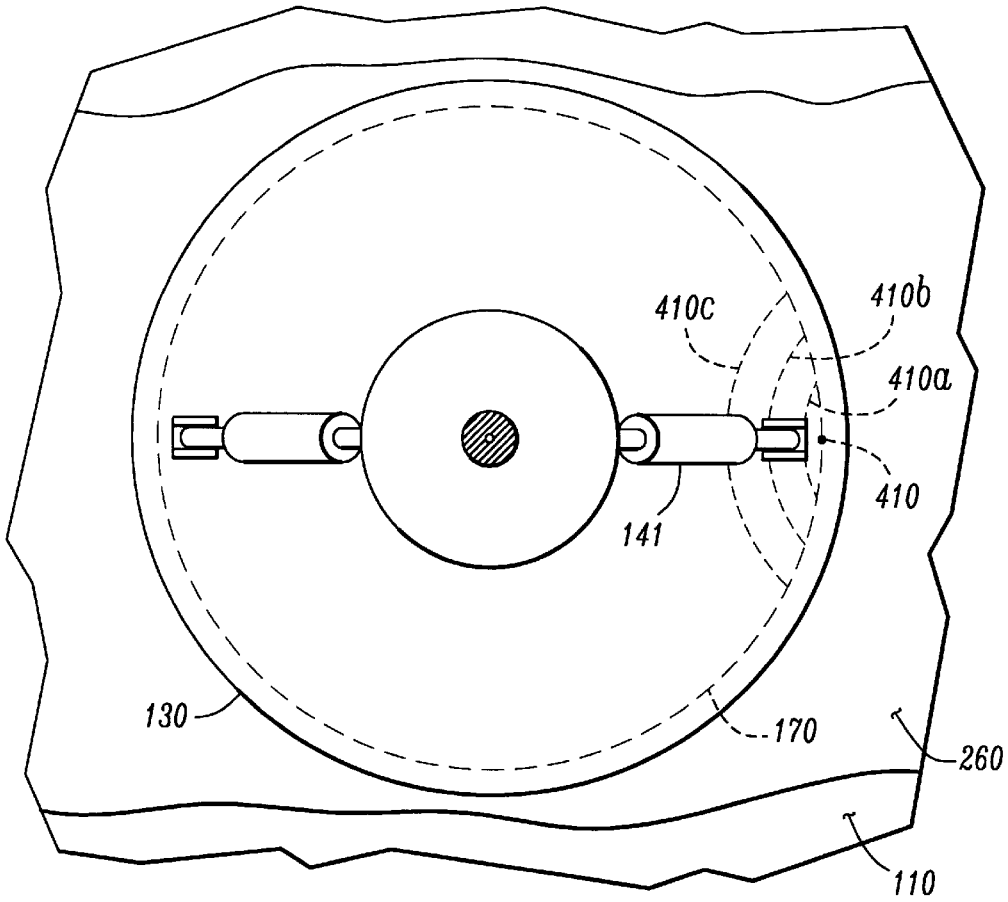
FIG. 4 illustrates a plan view of the pivoting apparatus of FIG. 2 as the pivoting device is foreshortened.

Referring now to FIG. 4 with continuing reference to FIG. 3, illustrated is a plan view of the pivoting apparatus of FIG. 2 as the pivoting device is foreshortened. As the pivoting device 141 shortens further, the adhesion of the slurry to the semiconductor wafer 170 fails first at a point 410 on the circumference of the wafer 170 radially outward from the attach point of the first pivoting device 141 to the carrier head 130. Once past the point 410, the edge of the meniscus 365 will move rapidly in a manner similar to the moving planform, shown as 410*a*, 410*b* and 410*c*, until the adhesion force between the wafer 170 and the slurry 260 is completely overcome.

Figure 5:
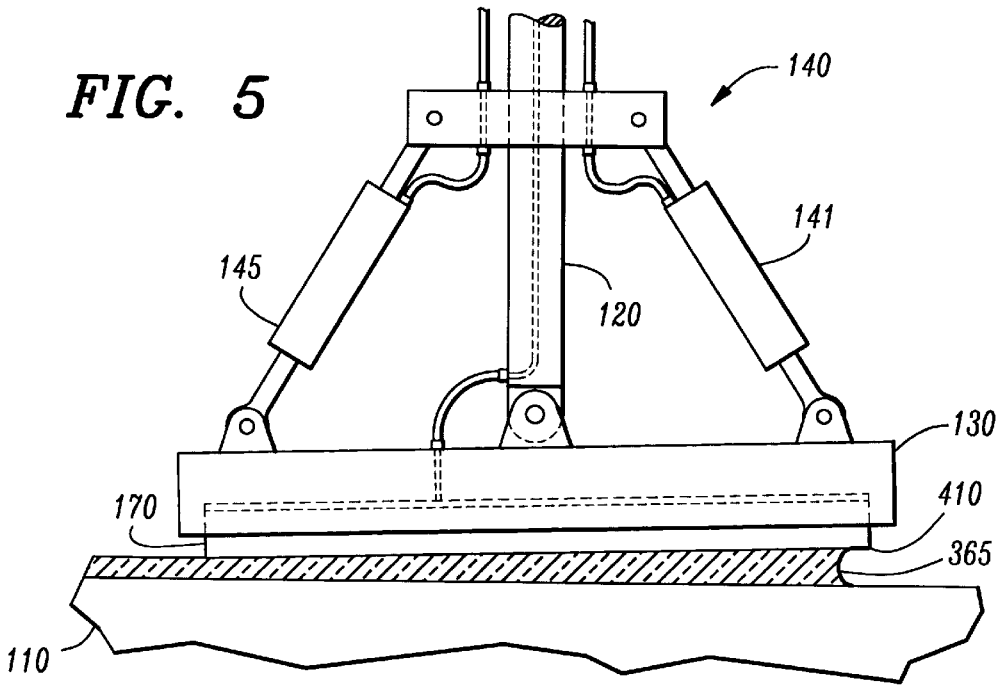
FIG. 5 illustrates a profile view of the pivoting apparatus of FIG. 2 as the pivoting device is foreshortened.

Referring now to FIG. 5, illustrated is a profile view of the pivoting apparatus of FIG. 2 as the pivoting device is foreshortened. As the first pivoting device 141 is foreshortened, the meniscus 365 may momentarily take a shape similar to that shown as the carrier head 130 continues to pivot. Once the meniscus 365 breaks from the point 410 on the edge of the semiconductor wafer 170, the adhesion force rapidly diminishes. Rotation of the carrier head 130 may be continued until the rotating shaft 120 and carrier head 130 can be lifted from the polishing surface 110.

Figure 6:
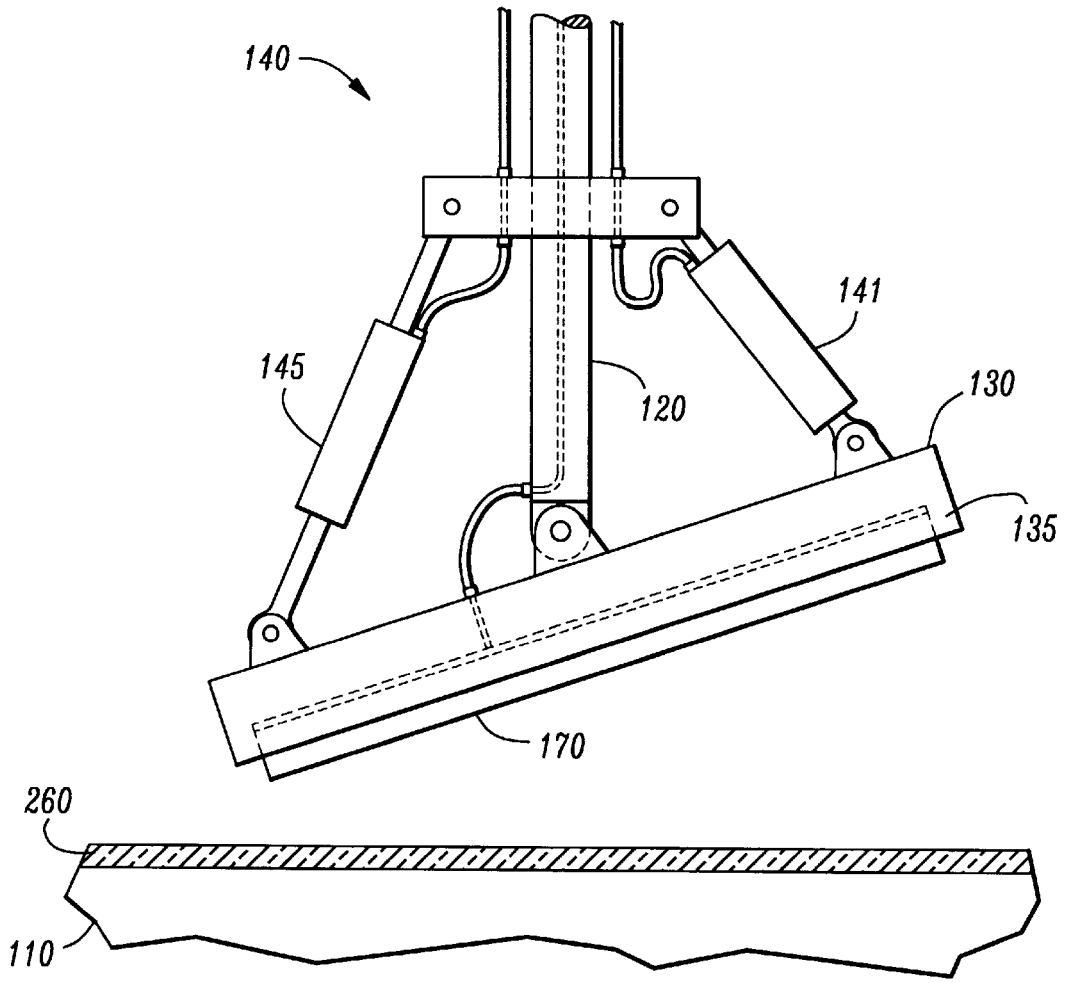
FIG. 6 illustrates a profile view of the pivoting apparatus of FIG. 2 above the polishing surface.

Referring now to FIG. 6, illustrated is a profile view of the pivoting apparatus of FIG. 2 above the polishing surface. With the carrier head 130 a sufficient height above the polishing surface 110, the second pivoting device 145 may be extended. This extension of the second pivoting device 145 may rotate the wafer 170 from an angle less than about 90 degrees. In a particular aspect of this embodiment, the range of the angle is less than about 80 degrees to about 60 degrees with respect to the rotatable shaft 120 so that the wafer 170 may be inspected.

From the foregoing it is apparent that the present invention provides a unique polishing apparatus, such as a chemical/mechanical polishing apparatus, that includes a pivoting apparatus having a first end coupled to a carrier head and a second end coupled to a rotatable shaft wherein the pivoting apparatus is configured to exert a pivoting force against the carrier head and pivot the carrier head with respect to the rotatable shaft to more easily break the vacuum formed by the slurry during the polishing process. This system provides a polishing apparatus that can reduce the amount of semiconductor wafer breakage associated with present processes and apparatus.

Although the present invention has been described in detail, those skilled in the art should understand that they can make various changes, substitutions and alterations herein without departing from the spirit and scope of the invention in its broadest form.

What is claimed is:

1. A polishing apparatus, comprising:

a polishing surface against which an object is to be polished;

a rotatable shaft having an axis substantially normal to said polishing surface;

a carrier head pivotably coupled to and rotatable with said rotatable shaft and configured to retain said object, said carrier head engageable against said polishing surface by way of said rotatable shaft and having an operating angle substantially normal to said rotatable shaft; and a pivoting apparatus having a first end coupled to said carrier head and a second end coupled to said rotatable shaft, said pivoting apparatus configured to exert a pivoting force with respect to said carrier head to pivot said carrier head with respect to said rotatable shaft.

2. The polishing apparatus of claim 1 wherein said pivoting apparatus includes first and second pivoting devices coupled on opposing sides of said carrier head, said first and second pivoting devices having first ends coupled to said carrier head and second ends coupled to said rotatable shaft.

3. The polishing apparatus of claim 1 wherein said pivoting apparatus is fluid actuated and is configured to exert a pivoting force with respect to said carrier head in response to a change of fluid pressure within said pivoting apparatus.

4. The polishing apparatus of claim 3 wherein said pivoting apparatus is a pneumatic actuated cylinder in fluid connection with a gas reservoir by a conduit.

5. The polishing apparatus of claim 3 wherein said pivoting apparatus is a hydraulic actuated cylinder in fluid connection with a hydraulic fluid reservoir by a conduit.

6. The polishing apparatus of claim 1 wherein said pivoting apparatus is a mechanical driver system operably coupled to a motor and said carrier head is pivoted by said mechanical driver system.

7. The polishing apparatus of claim 1 wherein said pivoting apparatus is configured to pivot said carrier head to an angle relative to said rotatable shaft sufficient to break a slurry surface tension created during polishing of said object.

8. The polishing apparatus of claim 7 wherein said angle ranges from less than about 90 degrees to about 60 degrees with respect to said rotatable shaft.

9. The polishing apparatus of claim 1 wherein said rotatable shaft is coupled to a swing arm rotatable about a vertical axis of said polishing apparatus.

10. The polishing apparatus of claim 1 wherein said object is a semiconductor wafer and said carrier head further includes a carrier ring configured to retain said semiconductor wafer therein.

11. A chemical/mechanical polishing apparatus for polishing a semiconductor wafer, comprising:

a polishing surface against which said semiconductor can be polished;

a swing arm coupled to and rotatable about a vertical axis of said polishing apparatus;

a rotatable shaft coupled to said swing arm and having an axis substantially normal to said polishing surface;

a carrier head pivotably coupled to and rotatable with said rotatable shaft and configured to retain said semiconductor wafer therein, said semiconductor wafer engageable against said polishing surface by way of said carrier head and said rotatable shaft and said carrier head having an operating angle substantially normal to said rotatable shaft; and a pivoting apparatus having a first end coupled to said carrier head and a second end coupled to said rotatable shaft, said pivoting apparatus configured to exert a pivoting force with respect to said carrier head to pivot said carrier head to an angle with respect to said rotatable shaft.

12. The chemical/mechanical polishing apparatus of claim 11 wherein said pivoting apparatus includes first and second pivoting devices coupled on opposing sides of said carrier head, said first and second pivoting devices having first ends coupled to said carrier head and second ends coupled to said rotatable shaft.

13. The chemical/mechanical polishing apparatus of claim 11 wherein said pivoting apparatus is fluid actuated and is configured to exert a pivoting force with respect to said carrier head in response to a change of fluid pressure within said pivoting apparatus.

14. The chemical/mechanical polishing apparatus of claim 13 wherein said pivoting apparatus is a pneumatic actuated cylinder in fluid connection with a gas reservoir by a fluid connection.

15. The chemical/mechanical polishing apparatus of claim 13 wherein said pivoting apparatus is a hydraulic actuated cylinder in fluid connection with a hydraulic fluid reservoir by a conduit.

16. The chemical/mechanical polishing apparatus of claim 11 wherein said pivoting apparatus is a mechanical driver system operably coupled to a motor and said carrier head is pivoted by said mechanical driver system.

17. The chemical/mechanical polishing apparatus of claim 11 wherein said angle is less than about 90 degrees.

18. The chemical/mechanical polishing apparatus of claim 17 wherein a range of said angle is less than about 80 degrees to about 60 degrees with respect to said rotatable shaft.

19. The chemical/mechanical polishing apparatus of claim 11 further including a carrier ring configured to retain said semiconductor wafer therein.

20. The chemical/mechanical polishing apparatus of claim 11 further including a slurry dispenser configured to dispense a slurry onto said polishing surface and a vacuum system configured to establish a suction against said semiconductor wafer and secure said semiconductor wafer against said carrier head.

21. A method for fabricating an integrated circuit, comprising:

forming an active device on a semiconductor wafer substrate;

depositing a layer of material over said active device and said substrate;

placing said semiconductor wafer in a carrier head, said carrier head substantially normal to a rotatable shaft;

positioning said semiconductor wafer against a polishing surface with a polishing slurry thereon;

polishing said layer of material;

substantially pivoting said carrier head with respect to said rotatable shaft; and removing said semiconductor wafer from said carrier head.

22. The method as recited in claim 21 wherein pivoting includes foreshortening a pivoting device coupled to said carrier head, said pivoting device having a first end coupled to said carrier head and a second end coupled to said rotatable shaft.

23. The method as recited in claim 22 wherein said foreshortening includes actuating said pivoting device with a fluid to exert a pivoting force with respect to said carrier head.

24. The method as recited in claim 22 wherein said foreshortening includes actuating said pivoting device with a pneumatic cylinder in fluid connection with a gas reservoir by a conduit.

25. The method as recited in claim 22 wherein said foreshortening includes actuating said pivoting device with a hydraulic cylinder in fluid connection with a hydraulic fluid reservoir by a conduit.

26. The method as recited in claim 22 wherein said foreshortening includes actuating said pivoting device with a mechanical driver system operably coupled to a motor and said carrier head is pivoted by said mechanical driver system.

27. The method as recited in claim 22 wherein said substantially pivoting includes pivoting said carrier head to an angle relative to said rotatable shaft sufficient to break a slurry surface tension created during polishing of said semiconductor wafer.

28. The method as recited in claim 27 wherein said pivoting includes pivoting said carrier head to an angle ranging from less than about 90 degrees to about 60 degrees with respect to said rotatable shaft.

* * * * *